United States Patent [19]

Ferguson

[11] Patent Number: 4,738,730

[45] Date of Patent: Apr. 19, 1988

[54] STEAM SEALING FOR NITROGEN TREATED FERROUS PART

[75] Inventor: Howard Ferguson, Okemos, Mich.

[73] Assignee: Lindberg Corporation, Chicago, Ill.

[21] Appl. No.: 830,536

[22] Filed: Feb. 18, 1986

[51] Int. Cl.[4] ..... C21D 1/74

[52] U.S. Cl. ..... 148/16.5; 148/16.6; 148/318; 148/319

[58] Field of Search ..... 148/16.6, 126.1, 16.5, 148/31.5, 148, 318, 319

[56] References Cited

U.S. PATENT DOCUMENTS

| | | | |
|---|---|---|---|
| 2,074,185 | 3/1937 | Langhammer et al. | 148/1 |
| 2,401,221 | 5/1946 | Bourne | 75/22 |
| 2,493,951 | 1/1950 | Druyvesteyn | 148/13.2 |
| 3,007,822 | 11/1961 | Kaiser | 148/126 |
| 3,028,656 | 4/1962 | Herbert | 29/25.42 |
| 3,194,658 | 7/1965 | Storchheim | 75/206 |
| 3,540,922 | 11/1970 | Brown | 117/127 |
| 3,567,527 | 3/1971 | Pevar | 148/127 |
| 3,837,848 | 9/1974 | Wessel | 75/203 |
| 4,071,382 | 1/1978 | Riopelle | 148/16.6 |
| 4,168,162 | 9/1979 | Shafer | 75/252 |
| 4,255,193 | 3/1981 | Slesar et al. | 75/206 |
| 4,501,613 | 2/1985 | Matsumoto | 148/16.6 |

OTHER PUBLICATIONS

Steam Treatment of Pourous Iron, by F. V. Lenel, Ch. 46.

*Primary Examiner*—R. Dean

*Attorney, Agent, or Firm*—Weingarten, Schurgin, Gagnebin & Hayes

[57] ABSTRACT

A ferrous, sintered, powdered metal part is steam sealed and gas ferritic nitrocarburized to provide a part useful for high hardness applications without the brittleness normally associated with conventional hardening. The steam treating of the ferrous metal part seals off the interconnected porosity of the part with a coating of $Fe_2O_3$, but not FeO, to limit the penetration of nitrocarburizing gases so that they produce a surface hardening without contributing to internal brittleness that results from the deeper penetration of the nitrogen treatment.

20 Claims, 2 Drawing Sheets

STEAM SEALING FOR NITROGEN TREATED FERROUS PART

FIELD AND BACKGROUND OF THE INVENTION

The present invention relates to the hardening of ferrous or iron based powdered metal part. It is known to harden a ferrous part by gas nitrocarburizing of the part. This process accomplishes hardening by the formation of an epsilon iron nitride compound of relatively low temperatures which is desirable as less part distortion is produced, limiting the needed amount of subsequent machining that may be necessary for the part's ultimate use.

Such hardened parts are particularly desirable in applications where the part is required to bear against another part and must be able to withstand the wear induced by the resulting contact. Automotive parts are one example of the area of use where such hardened parts are particularly desired because of the many instances where one part must interract with another part.

While the surface hardening of the powdered metal part is desirable, it is equally important that the part retain its inner or core ductility after the hardening. Thus, the formation of epsilon iron nitride beneath the surface of the part by penetration of the nitrocarburizing gases through the interconnected pores causes the same hardening effect deep into the part, producing an unwanted brittleness of the part. As is commonly the case, such parts are initially fabricated by sintering which achieves a part that permits easy penetration of the hardening environment through the inherent porosity of sintered powdered metal parts.

SUMMARY OF THE INVENTION

According to the teaching of the present invention, a typically sintered, ferrous part is hardened by nitrocarburization which is limited to substantially a surface effect by subjecting the ferrous part to an initial steam sealing step which produces an $Fe_2O_3$ coating throughout the interconnecting porosity of the part. This coating limits the penetration of the epsilon iron nitride layer applied during nitrocarburizing to achieve a surface hardened part that retains its sintered characteristics in the core.

The ferrous part or parts to be treated are introduced into a chamber or retort, then heated to approximately 450°-750° F. and purged of air to avoid the formation of rust, FeO, deposits on the parts in a subsequent steam treatment step. Steam is introduced, the temperature is then raised to approximately 1000°-1100° F. and the part is allowed to age at this temperature for, for example, 30-60 minutes, or longer.

The parts thus treated are coated with a layer of ferric oxide ($Fe_2O_3$) throughout their interconnected porosity. They are, after optional cooling and purging, exposed to an environment of anhydrous ammonia and a mixture of endothermically generated gases, which may include hydrogen, carbon monoxide, nitrogen, and lesser amounts of carbon dioxide and free methane. This mixture is elevated to a temperature of approximately 1050°-1100° F. and maintained there for 30-60 minutes to achieve a surface hardening by nitrocarburization. The nitrocarburization is impeded by the ferric oxide layer from penetrating into the part interior where it would produce brittleness.

The part thus hardened may be subsequently machined as desired, although by limiting the hardening to the part surface, such little change of part dimension is produced that machining may not be necessary for its intended application.

DESCRIPTION OF THE DRAWING

These and other features of the present invention are more fully described below in the solely exemplary detailed description and accompanying drawing of which.

DETAILED DESCRIPTION

Figure 1:
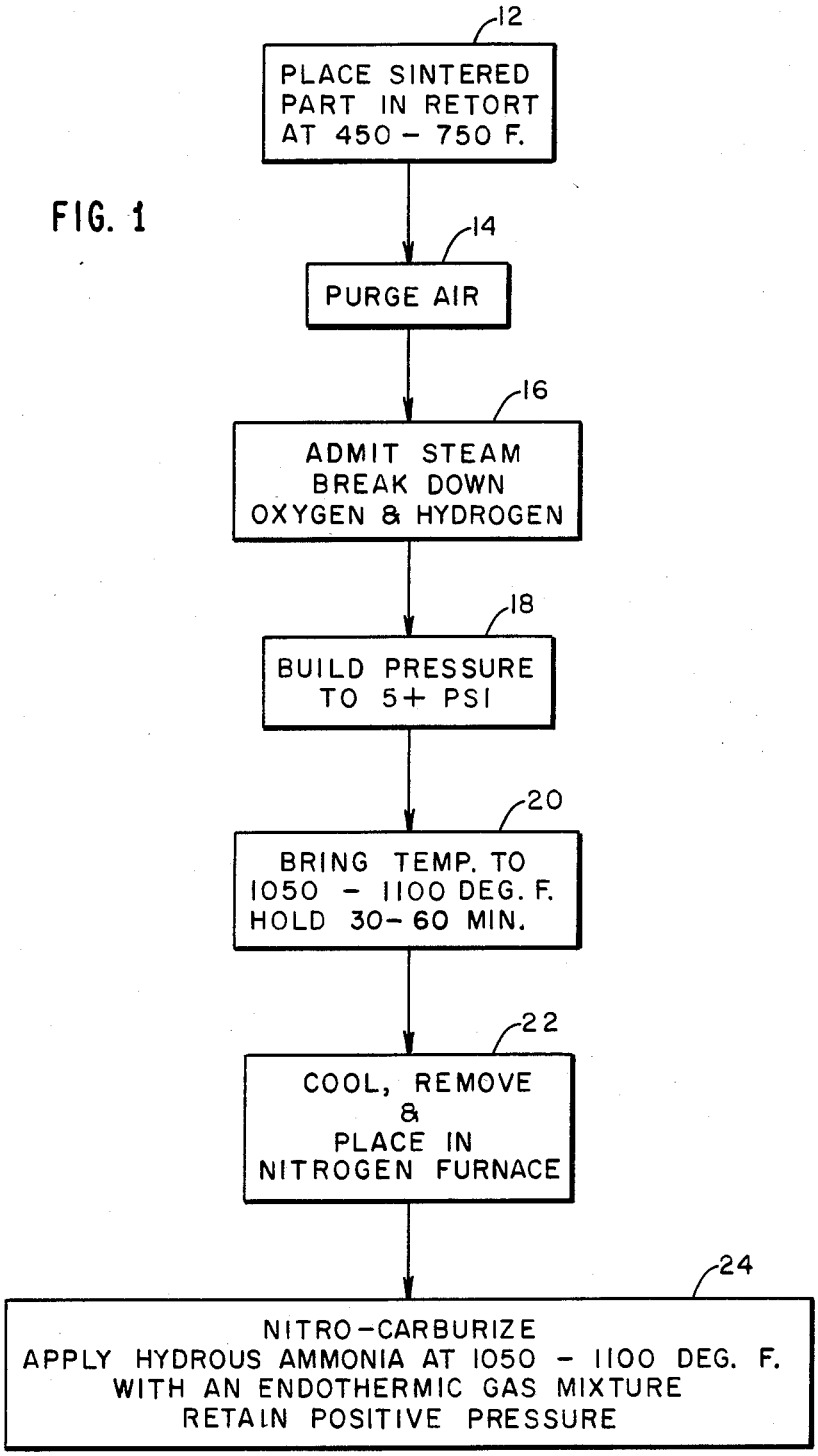
FIG. 1 illustrates the steps exemplary of a preferred embodiment of the invention.

The present invention contemplates the production of a surface hardened ferrous powdered metal part by the steam sealing of the part with a coating of $Fe_2O_3$ throughout the interconnected porosity and by a subsequent nitrocarburizing of the part to achieve the desired surface hardening.

The present invention is particularly useful in the surface hardening of sintered ferrous parts. Typically the part is initially formed by sintering compacted, low carbon steel particles of, for example, 80-100 mesh. The part may contain up to 5% of copper and nickel to impart hardness and 0%-0.5% of graphite. The copper and nickel is largely unnecessary as the nitrocarburization accomplishes the hardening that these additives were normally intended to impart. The sintering typically accomplishes a densification of 80%-90%. These figures are examples of the type of part on which the present invention is particularly useful but are not seen as limitations on the nature of the ferrous part to be so treated.

Such a sintered or other ferrous part is next placed in a retort as illustrated by step 12 of the drawing. The temperature of the retort and part is raised to approximately 450°-750° F. and the atmosphere or environment of the retort purged of air and other gases in step 14 to insure that the steam treatment produces a ferric oxide ($Fe_2O_3$) and not a ferrous oxide (FeO) coating. In subsequent step 16, steam is admitted to the retort where it breaks down into hydrogen and oxygen components at the interior temperature. The retort is brought up to an elevated pressure, typically approximately 5 psi in step 18, and the temperature is subsequently raised to the range of approximately 1050°-1100° F. in step 20. This temperature is substantially the same as the subsequent temperature utilized in the nitrocarburization. Temperatures as low as 1025° F. may be used. The part and its environment are held at this temperature for approximately 30-60 minutes.

As a result of the steam treatment, the parts in the retort are coated throughout their exposed pores with ferric oxide $Fe_2O_3$, imparting a blue-black appearance to the parts.

After the steam treatment, the parts may be cooled, removed from the steam furnace and placed in a heat treating furnace for nitrocarburizing according to step 22. The parts are then nitrocarburized in step 24.

To achieve the nitrocarburization, anhydrous ammonia is applied to the retort or furnace at 1050°-1100° F. along with a mixture of endothermically produced gases. These gases are typically achieved by endothermically reacting natural gas with air. The resulting mixture typically includes 40% each of nitrogen and hydrogen, 20% of carbon monoxide and lesser amounts of carbon dioxide and free methane. The processing temperature is kept below 1100° F. to prevent the formation of austenite in the parts. The environment is kept at a slight positive pressure of approximately one-half inch of water to prevent air contamination and gases from the chamber are exhausted up a stack and burned before release to the atmosphere. The part is subject to this atmosphere for approximately 30–60 minutes.

The resulting part is surface hardened with an easily machined characteristic while the interior of the sintered material retains it original strength and ductility without the brittleness that nitrogen treating can impart. With less machining needed the economy of part production is much improved.

The ranges given above are exemplary and depending upon the part may be departed from. An example of the invention is given below.

A powdered metal camplate and rotor assembly for an hydraulic booster pump on an automobile power steering system is subjected to the sealing and nitrocarburizing process as follows:

The parts are fabricated of powdered metal of the designation F-0000-P and compacting to a density of 6.3 gm/cc.The metal composite comprises iron (Fe) plus 0.30% carbon (C). The parts are prepared for steam treatment according to the above description. Steam treatment comprises 30 minutes of exposure to steam at 1050° F. This accomplishes pore closure of a minimum of 60% at the surface. The parts are then prepared for nitrocarburization according to the above description and processed for 45 minutes at 1050° F. in a gas mixture of 65% ammonia and 35% enothermic gases. The resulting parts exhibit a uniform layer of epsilon nitride at the surface extending to a depth of no greater than 0.015 inches.

Figure 2:
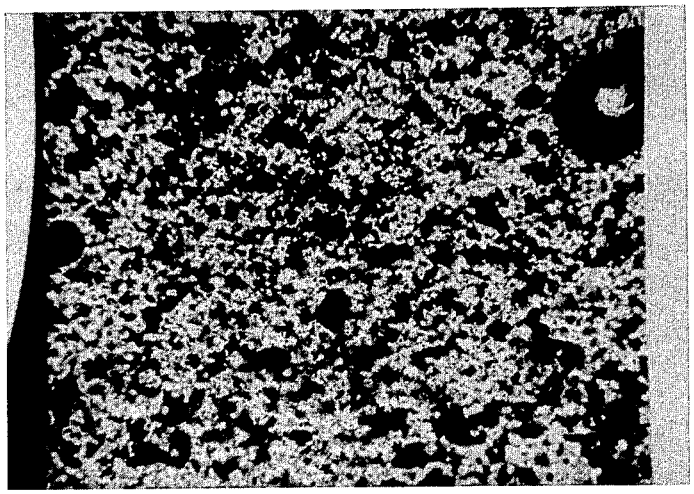
FIG. 2 is a photomicrograph of nitrocarburization without steam sealing.
Figure 3:
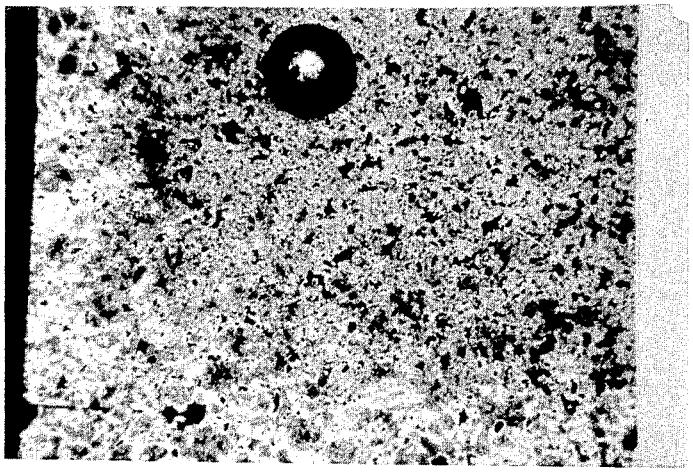
FIG. 3 shows the part of FIG. 2 with prior stream sealing.

FIGS. 2 and 3 respectively show photomicrographs of the parts for this example that have been nitrocarburized with and without steam sealing. The complete uniformity of the epsilon nitride throughout the part exhibited in FIG. 2 is limited to the surface fraction of the part in the view of FIG. 3. Both Figures are views at a magnification of 400.

It is to be noted that the description of the invention given above is exemplary of its practice, and the scope of the invention is to be indicated only by the following claims.

I claim:

1. A process for producing a nitrogen hardened ferrous powdered metal material comprising the following steps in the order recited:

heating the material and purging it of air;

steam sealing the as yet unnitrided material in a predetermined environment; and nitrogen hardening the steam sealed ferrous material to a depth limited by the steam sealing thereof.

2. The process of claim 1 wherein said heating and purging step includes the step of placing the ferrous material in a retort.

3. The process of claim 2 wherein in said heating and purging step the retort is heated to approximately at least 450° F.

4. The process of claim 1, wherein said steam sealing step further includes the step of establishing an elevated pressure in the environment around the ferrous material.

5. The process of claim 4 wherein said elevated pressure is approximately at least 5 psi.

6. The process of claim 1, wherein said steam treatment step further includes the step of holding the ferrous material at a temperature of approximately 1000°–1100° F. for a predetermined time period.

7. The process of claim 6 wherein the predetermined time period is approximately 30–60 minutes.

8. The process of claim 1 further including the step of placing the steam sealed ferrous material in a different environment prior to the nitrogen hardening step.

9. The process of claim 1 wherein said step of nitrogen hardening the steam sealed ferrous material includes the step of nitrocarburizing the steam sealed ferrous material.

10. The process of claim 9 wherein the nitrocarburizing step includes the step of applying anhydrous ammonia to the steam sealed ferrous material.

11. The process of claim 10 wherein said step of applying anhydrous ammonia is carried out at approximately 1050°–1100° F.

12. The process of claim 9 further including the step of applying said anhydrous ammonia with an endothermic gas mixture.

13. The process of claim 12 wherein the ratio of anhydrous ammonia to endothermic gas is in the range of 50/50 to 70/30.

14. The process of claim 12 wherein said endothermic gas mixture consists of carbon monoxide, carbon dioxide, nitrogen, hydrogen, and free methane.

15. The process of claim 14 wherein the endothermic gas mixture includes approximately 40% nitrogen and hydrogen, 20% carbon monoxide, and small amounts of carbon dioxide and free methane.

16. The process of claim 9 wherein the nitrocarburizing step includes the step of retaining a positive pressure on the ferrous material.

17. The process of claim 1 wherein said ferrous material is a sintered part.

18. A process for producing a nitrogen hardened ferrous part comprising the following steps in the order recited:

heating the ferrous part and purging it of air;

applying steam to the as yet unnitrided ferrous part at an elevated temperature to produce a surface reaction with the part while substantially avoiding the production of rust at the surface of said part;

nitrocarburizing the steam treated ferrous part to produce surface hardening thereof.

19. A surface hardened part produced according to the process of claim 1.

20. A surface hardened part produced according to the process of claim 18.

* * * * *